US006005516A

United States Patent [19]

Reudink et al.

[11] Patent Number: 6,005,516

[45] Date of Patent: Dec. 21, 1999

[54] DIVERSITY AMONG NARROW ANTENNA BEAMS

[75] Inventors: Douglas O. Reudink; Mark Reudink, both of Bellevue; Martin J. Feuerstein, Redmond, all of Wash.

[73] Assignee: Metawave Communications Corporation, Redmond, Wash.

[21] Appl. No.: 08/923,051

[22] Filed: Sep. 3, 1997

Related U.S. Application Data

[63] Continuation-in-part of application No. 08/726,277, Oct. 4, 1996, Pat. No. 5,757,318, which is a continuation of application No. 08/488,793, Jun. 8, 1995, Pat. No. 5,563,610.

[51] Int. Cl.[6] ..... H01Q 3/22

[52] U.S. Cl. ..... 342/375; 455/277.2

[58] Field of Search ..... 342/375; 455/278.1, 455/279.1, 277.1, 277.2

[56] References Cited

U.S. PATENT DOCUMENTS

| | | | |
|---|---|---|---|
| 4,701,935 | 10/1987 | Namiki | 375/4 |
| 5,280,472 | 1/1994 | Gilhousen et al. | 370/18 |
| 5,347,535 | 9/1994 | Karasawa et al. | 375/1 |
| 5,459,873 | 10/1995 | Moore et al. | 455/277.1 |
| 5,530,926 | 6/1996 | Rozanski | 455/277.2 |
| 5,596,333 | 1/1997 | Bruckert | 342/457 |

OTHER PUBLICATIONS

Dennis A. Jiraud; "Broadband CDMA for Wireless Communications"; Applied Microwave & Wireless; pp. 22–34.

CDMA Network Engineering Handbook; Draft Version XI; Chapter 2; pp. 2–1 through 2–12.

*Primary Examiner*—Theodore M. Blum

*Attorney, Agent, or Firm*—Fulbright & Jaworski L.L.P.

[57] ABSTRACT

A receiving system 100 is disclosed which includes at least one antenna 101 providing a plurality of antenna beams providing signal diversity between communicated signals. A first processing branch 103 is included for processing a first plurality of signals appearing within a first plurality of the antenna beams. The first processing branch 103 includes a plurality of signal paths, some of which include delays 105, each receiving a one of the first plurality of signals from a corresponding one of the first plurality of antenna beams. Delays 105 apply a predetermined amount of delay proportionate to the corresponding one of the beams. First processing branch 103 further includes a combiner 106 for combining the first plurality of signals after output from the plurality of signal paths. A second processing branch 104 is provided for processing a second plurality of signals appearing within a second plurality of the antenna beams. Second processing branch 104 includes a plurality of signal paths, some of which include delays 105, each receiving one of the second plurality of signals from a corresponding one of the second plurality of antenna beams. Delays 105 applying a pre-selected amount of delay to the corresponding one of the beams. Second processing branch 104 further includes a combiner 106 for combining the second plurality of signals after output from the plurality of signal paths. Finally, a radio 102 is provided having a first port coupled to an output of first processing branch 103 and a second port coupled to a second processing branch 104.

74 Claims, 6 Drawing Sheets

DIVERSITY AMONG NARROW ANTENNA BEAMS

REFERENCE TO RELATED APPLICATION

The present application is a continuation-in-part of and commonly assigned U.S. application Ser. No. 08/726,277, entitled "NARROW BEAM WIRELESS SYSTEMS WITH ANGULARLY DIVERSE ANTENNAS," filed Oct. 4, 1996, issued May 26, 1998, as U.S. Pat. No. 5,757,318, which application is itself a continuation of commonly assigned U.S. application Ser. No. 08/488,793, entitled "NARROW BEAM ANTENNA SYSTEMS WITH ANGULAR DIVERSITY," filed Jun. 8, 1995, now issued as U.S. Pat. No. 5,563,610, each of which are hereby incorporated by reference herein.

The present application is also related to commonly assigned, U.S. application Ser. No. 08/520,316, entitled "NARROW BEAM ANTENNA SYSTEMS WITH ANGULAR DIVERSITY," issued Jul. 15, 1997, as U.S. Pat. No. 5,648,968, and U.S. application Ser. No. 08/520,000, entitled "SYSTEM AND METHOD FOR FREQUENCY MULTIPLEXING ANTENNA SIGNALS," issued Jan. 12, 1999, as U.S. Pat. No. 5,859,854, each of which are hereby incorporated by reference herein.

TECHNICAL FIELD OF THE INVENTION

The present invention relates in general to wireless communications systems and in particular to apparatus, systems and methods for combining multiple antenna beams in such systems.

BACKGROUND OF THE INVENTION

Code division multiple access (CDMA) signalling is particularly useful in wireless communications systems, such as cellular telephone systems. Among its advantages, CDMA allows multiple users to simultaneously access a single channel. In a typical CDMA system, a pseudo-noise spreading code (in a direct sequence system a sequence of "chips") is used to bi-phase modulate an RF carrier. The resulting phase-coded carrier is in turn bi-phase modulated by a data stream. A second orthogonal code overlays the spreading code which allows a base station to individually identify and communicate with multiple mobile units. The resulting coded CDMA signal is then amplified and transmitted. At the receiver, the CDMA signal is despread and the data extracted by demodulation.

The performance of all wireless communications systems, including CDMA systems, is adversely affected by interference. One source of interference at the base station is caused by the simultaneous receipt of signals from multiple remote (mobile) units, and in particular when those mobile units are broadcasting on the same frequency. Assuming an ideal antenna and signal propagation conditions, and that the base station is receiving signals of substantially the same power from each of the mobile units, the level of interference noise is directly proportional to the number of mobile unit signals received at the base station antenna. The multiple received signals can raise the noise floor or destructively combine to cause fading. This problem is compounded when a mobile unit closer to the base station masks the signals received from mobile units further distant.

Another type of interference which adversely affects wireless communications systems is caused by multipath effects. In this case, the signal broadcast from a given mobile unit will reflect off various objects in the surrounding environment. As a result, multiple reflected signals taking multiple paths of varying path lengths arrive at the receiver. These multipath components (reflections) arrive at the receiver antenna with varying time delays (phase differences), and depending on the corresponding path lengths, may combine to produce fades in signal strength. In the worst case where multipath signals are received one-half wavelength out of phase, a null can occur due to signal cancellation.

By minimizing interference, the strength of a given mobile unit signal received at the base station antenna can be maximized. Consequently, the mobile unit to base station separation and/or the ability to extract data from that signal is improved (i.e. an improved bit-error rate is achieved). A similar result can be achieved if the gain of the receiver and/or its antenna is increased. The most substantial improvements in receiver performance occur if interference minimization is achieved in conjunction with an increase in gain.

The Rake receiver is a standard receiver often used in CDMA base wireless communications systems because of its capability of reducing multipath fading. In one configuration, the Rake receiver receives data from three 120 degree sectors, together providing 360 degree coverage. Each 120 degree sector is covered by two 120 degree antennas with identical views, one antenna feeding the receiver sector (main) port and the other feeding the receiver diversity port. Alternatively, omni-directional antennas may be used to feed a CDMA receiver having only a sector and a diversity port. According to the IS-95 standard, each CDMA receiver is constructed from four Rake receivers, each for resolving one "finger" (i.e. time delayed multipath components from a given mobile unit). In this case, the four strongest signals received from any sector or the diversity antennas are processed by the corresponding four fingers of the receiver and combined to improve data recovery.

It should be noted that in current CDMA receiving systems, the antennas are typically separated by a predetermined number of wavelengths in order to provide spacial diversity. This spacial diversity insures that the incoming multipath components from a given mobile unit transmission are substantially uncorrelated. Two such prior art systems are disclosed in U.S. Pat. No. 5,347,535 to Karasawa et al., entitled "CDMA Communications System," and U.S. Pat. No. 5,280,472 to Gilhousen et al., entitled "CDMA Microcellular Telephone System And Distributed Antenna System Therefor."

If the number of required antennas could be reduced, and/or the need to space antennas by substantial distances could be eliminated, a more compact and less complicated CDMA base station could be built. Further, if in doing so, interference reduction and gain improvement could also be achieved, the receiver operation could simultaneously be improved.

In sum, the need exists for improved apparatus, systems and methods for receiving CDMA signals in a wireless communications system. Such apparatus, systems and methods should reduce fading caused by interference and improve receiver gain. Further, the ability to build a more compact Rake receiver based CDMA receiver system would also be of substantial advantage.

SUMMARY OF THE INVENTION

The principles of the present invention allow for multiple antenna beams to be used to feed a smaller number of receiver input ports. Such multiple beams may be provided by either a single multibeam antenna or a plurality of co-located discreet antennas. By using multiple, narrow, beams to focus on selected mobile units, interference can be substantially reduced and antenna gain substantially increased. Similarly, using polarized beams interference can be substantially reduced through the use of a beam polarized for selected mobile units. Systems embodying the principles of the present invention can be advantageously applied to wireless communication systems, such as cellular telephone systems, although such principles are not necessarily limited to these applications.

According to a first embodiment of the present invention, a communication system is provided which includes at least one antenna providing a plurality of antenna beams. A first processing branch is included for processing a first plurality of signals associated with first selected ones of the antenna beams. The first processing branch includes a plurality of signal paths preferably including at least one delay path. The signal paths each receive one of the first plurality of signals associated with a corresponding one of the first antenna beams. The delay path applies a pre-selected amount of delay proportionate to the corresponding one of the beams. The first processing branch also includes a combiner for combining the first plurality of signals. A second processing branch is provided for processing a second plurality of signals associated with second selected ones of the antenna beams. The second processing branch includes a plurality of signal paths preferably including at least one delay path. The signal paths each receive one of the second plurality of signals associated with a corresponding one of the second antenna beams. The delay path applies a pre-selected amount of delay being proportionate to the corresponding one of the beams. A combiner is also provided for combining the second plurality of signals. Finally, the communication system includes a radio having a first port coupled to an output of the first processing branch and a second port coupled to the second processing branch.

According to another embodiment of the present invention, a receiving system is provided which includes a CDMA receiver and a multibeam antenna providing a plurality of reception beams. A first plurality of signal paths couple the multibeam antenna with a sector input port of the receiver, whereby ones of the first plurality of signal paths introduce a predetermined amount of delay to a signal received from a corresponding one of a first set of the plurality of beams. A second plurality of signal paths couple the multibeam antenna with a diversity input port of the receiver, whereby ones of the second plurality of signal paths introduce a predetermined amount of delay to a signal received from a corresponding one of a second set of the plurality of beams.

Alternatively, the first and/or second plurality of signal paths couple the multibeam antenna with an associated input port of the receiver without the introduction of a predetermined amount of delay. Here the first and/or second plurality of signal paths provide combining of signals received from select ones of the corresponding plurality of beams for provision to the associated input port of the receiver.

According to a further embodiment of the present invention, a receiving system is provided which includes a plurality of antennas. First mixing circuitry is coupled to an output of selected ones of the antennas for mixing down signals received by those selected antennas. A plurality of delay devices are coupled to the mixing circuitry for delaying a mixed down signal received by a corresponding one of the selected antennas by a predetermined amount. Second mixing circuitry is coupled to the delay devices for up mixing delayed signals output from the delay devices. Signal combining circuitry is provided for combining the delayed signals output from the second mixing circuitry.

According to another embodiment of the present invention, a wireless communications receiving system is provided which includes a plurality of antennas and a CDMA receiver, the receiver having a number of inputs less than or equal to the number of antennas. A matrix switch is provided for coupling outputs of selected ones of the antennas to the inputs of the receiver.

The principles of the present invention provide substantial advantages over the prior art. In particular, multiple antennas may be connected to a receiver which has a number of input ports less than the number of antennas desired. Further, according to the present invention, narrow beam antennas may be used with a CDMA receiver to substantially reduce interference and provide increased antenna gain. Further, antennas constructed in accordance with the principles of the present invention do not require substantial, or even precise, spacing between antennas, as is required in present antenna systems to ensure that incoming signals are uncorrelated.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The principles of the present invention and their advantages are best understood by referring to the illustrated embodiment depicted in FIGS. 1–9 of the drawings, in which like numbers designate like parts.

Figure 7:
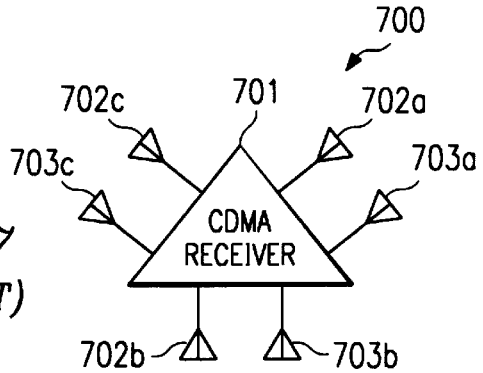
FIG. 7 (PRIOR ART)
FIG. 7 is a functional block diagram of a prior art CDMA receiving system.

FIG. 7 is a general block diagram of a CDMA base station configuration 700 typically used in presently available wireless communications systems, such as cellular telephone systems. In the conventional system of FIG. 7 the CDMA receiver 701 receives signals from three "faces," each of which covers a 120 degree sector. Each sector is concurrently covered by two antennas: a sector antenna 702 with a 120 degree field of coverage and diversity antenna 703, also with a field of coverage of 120 degrees. The sector antenna 702 and diversity antenna 703 for each face is physically spaced by a range of approximately 10–15 to 20 times the wavelength of the received signal. In current cellular telephone CDMA systems, this equates to approximately 10 to 20 feet. While further separation would be desirable to insure that the incoming signals are uncorrelated, increased separation is typically impractical due to space limitations.

Figure 1A:
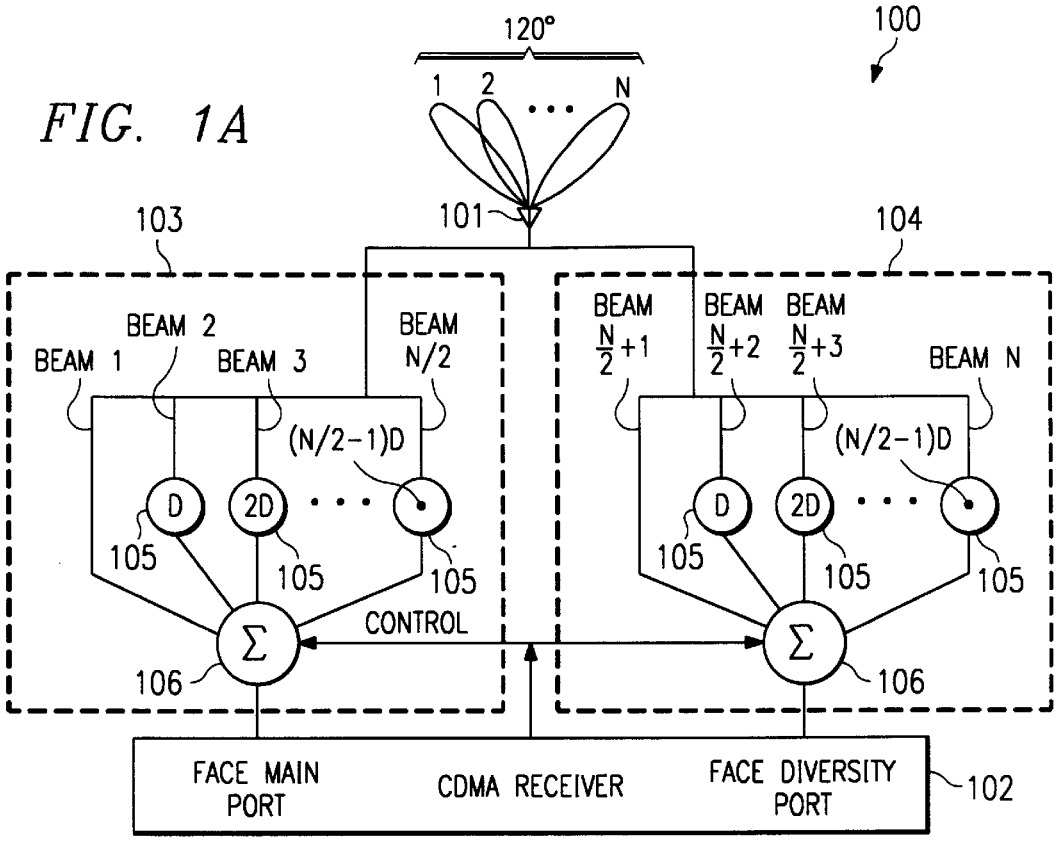
FIGS. 1A and 1B are functional block diagrams of exemplary receiving systems according to the principles of the present invention.

FIG. 1A is a block diagram of one face of a CDMA receiving system 100 according to one embodiment of the principles of the present invention. An N-beam multibeam antenna 101 feeds both the face sector input port and the face diversity input port of a CDMA receiver 102 through a pair of parallel processing branches 103 and 104. In a three sector configuration, the N beams of antenna 101 together provide a coverage area of 120 degrees (one sector). Multibeam antenna 101 may also be an omni-directional (i.e., multiple beams, for example twelve, covering 360 degrees) for use in a system configuration where CDMA receiver 102 includes only a main port and a diversity port. In the preferred embodiment, antenna 101 comprises a series of dipoles spaced in front of a ground plane in conjunction with a Butler matrix. In alternate embodiments, any of a number of multiple beam antennas known in the art can be used.

Figure 1B:
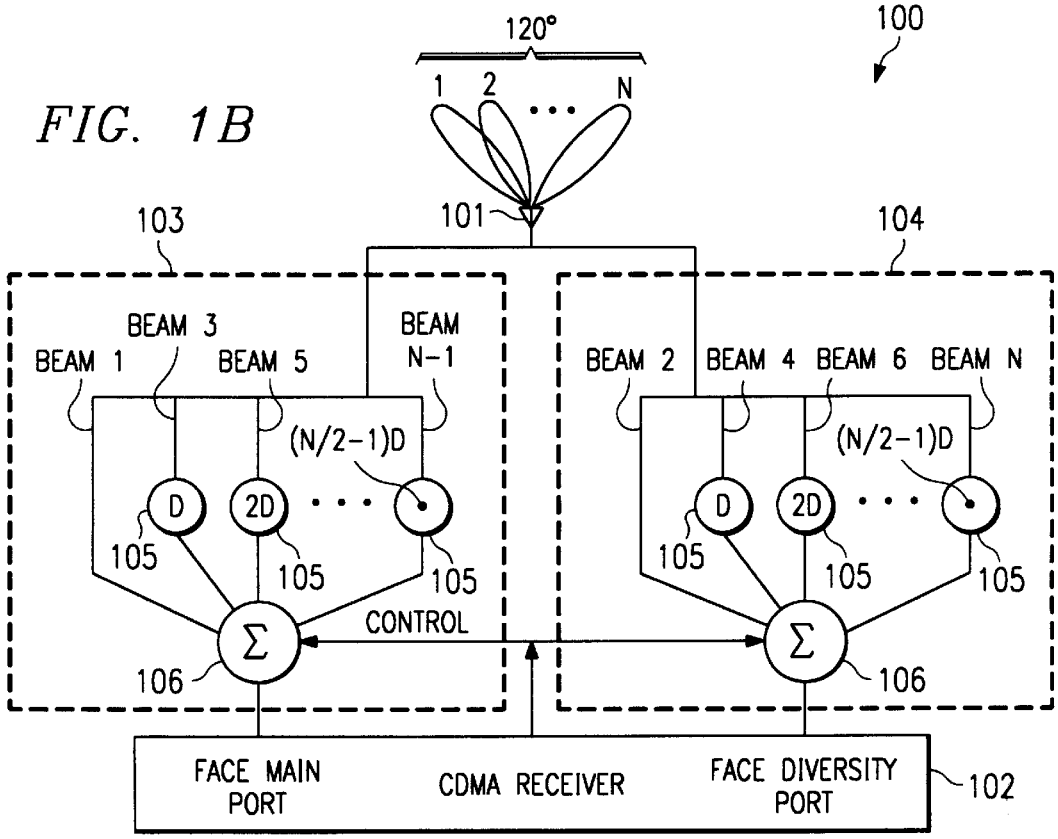
Figure 2:
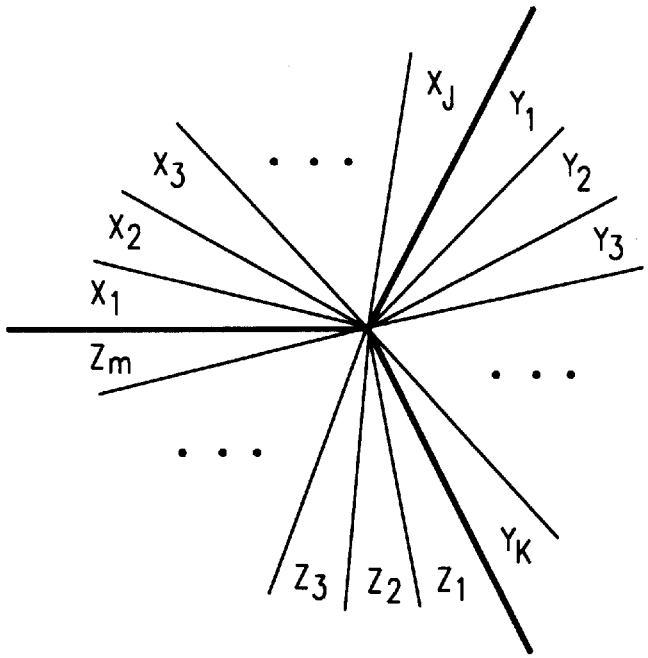
FIG. 2 is a beam diagram depicting one possible distribution of antenna beams according to the principles of the present invention.

The coverage from a three face configuration is shown for illustrative purposes in FIG. 2. Three multibeam antennas systems 100 are employed to cover 360 degrees with one antenna providing beams $X_1$–$X_j$ to the first face, a second providing beams $Y_1$–$Y_k$ to a second face and a third antenna providing beams $Z_1$–$Z_m$ to a third face (of course, a single multibeam antenna could be used in place of individual multibeam antennas, if desired). The variables j, k, and m are each equal to the variable N in FIG. 1.

In the embodiment of FIG. 1A, the first half of the N beams from antenna 101 (i.e. beams 1 to N/2 consecutively) feed the main port through branch 103 and the second half of the beams (i.e. beams N/2+1 to N consecutively) feed the diversity port through branch 104. In alternate embodiments, beams 1 to N/2 can feed the diversity port through branch 104 and beams N/2+1 to N feed the main port through branch 103 without affecting system operation. A second embodiment of system 100 is shown in FIG. 1B, where the odd numbered beams are processed through branch 103 and the even number beams are processed through branch 104. A number of other splits of the beams from antenna 101 through branches 103 and 104 are possible according to the principles of the present invention.

Each branch 103 and 104 includes a plurality of signal delay devices 105 and a combiner 106. The signals received by the respective beams are subjected to varying amounts of delay such that they are time-wise spread when they reach the corresponding ports of receiver 102. In the FIG. 1A embodiment, the beam with the lowest indicia (number) for each branch 103 and 104 (i.e. beam 1 and beam N/2 respectively) is passed to combiner 106 without the introduction of a delay. The beam with the second lowest indicia (i.e. beam 2 and N/2+1) receives a delay of one delay unit D, the next beams a delay of two delay units 2D, and so on. Ultimately, beams N/2 and N are delayed by (N/2–1)D units of delay. In other words, the delay for the signals output appearing within a given antenna beam having a beam number B is (B–1)D.

The unit of delay D can be approximated from the formula:

$$DN/2<64\ \mu\text{sec}$$

where D is the unit of delay and N is the number of antenna beams, as discussed above. This constraint arises because in current CDMA receiving systems an adjacent sector (face) could be receiving and processing signals with a 64 μsec delay with respect to the current phase. In other words, the signals received at the current sector are not delayed more than 64 μsec such that they do not overlap signals from the adjacent face reaching the ports of receiver 102.

Of course, the delay elements are not required to be evenly spaced according to the present invention. For example, a first delay may be 1 μsec, a second delay 3.5 μsec, and a third delay 4 μsec.

Likewise, the use of delay elements is not required according to the present invention. Accordingly, delay devices 105 may be omitted or their delay value D may be equated to zero.

Experimental evidence has shown that most multipath reflections resulting from a transmission arrive at an omni-directional antenna generally within 3–4 μsecs from the arrival of the first signal from the transmission (typically the direct signal). This corresponds to an approximate difference in path length of 3000 to 4000 feet. Further, most reflections off distant mirrors are substantially attenuated. For example, if a mobile is removed from the base station by 4 μsecs, a reflection off a mirror 2 μsecs further distant will return a signal to that base station 4 μsecs after the first signal arrival, but attenuated by 6 dB. In sum, for a given transmission, very little energy is received from a given transmission more than 5 μsecs after arrival of the first received signal. Of course, multipath reflections are highly dependent upon the environment and may vary accordingly.

The outputs of combiners 106 are fed to the sector and diversity ports of CDMA receiver 102. In the preferred embodiment, CDMA receiver 102 comprises a four finger Rake receiver whose front end delays substantially match, or are related to, the delays through branches 103 and 104. For example, the delays through branches 103 and 104 may be chosen so as to be long enough to exceed the resolution of the Rake receiver. Similarly, the delays could be chosen so as to be long enough to be processed by a second Rake receiver such as is present in a CDMA receiver according to the IS-95 standard. In the case of a four finger Rake receiver, the four strongest signals from all the faces are preferably taken for processing after the delays of branches 103 and 104. Alternatively, the four strongest signals from a single selected face may be taken at a time.

Where signal diversity provided by the multibeam antenna, such as through angular or spatial diversity, provides sufficiently uncorrelated signals associated with the various beams, the delays associated with branches 103 and 104 may be diminished or omitted. Likewise, where the various signals of interest are otherwise directly combinable, such as where they may be summed to provide a desired combined signal, the delays may be omitted.

In the preferred embodiment, delays 105 are implemented with surface acoustic wave (SAW) devices (e.g. SAW filters). Such devices achieve delay by converting electrical energy into acoustic waves, usually in a quartz crystal, and then recoupling the acoustic waves back into electrical energy at their output. Advantageously, such devices are compact and eliminate the unwieldy cables used to introduce delays in the prior art systems.

Also, in the preferred embodiment, combiners 106 are adaptive summing devices which perform signal combining as a function of signal power. The stronger the signal, the more weight that signal is given during the combining. For optimal performance, combiners 106 add signals according to the square of the signal power in each path (maximal ratio combining). If a path is carrying no signal, the path is attenuated strongly producing a weight of near zero. Preferably, CDMA receiver 102 includes a searcher or scan receiver which controls the adaptive summing devices and sets the weights. In the alternate embodiments, where no searcher or scan receiver is provided, the weights can be set as equal.

Figure 3:
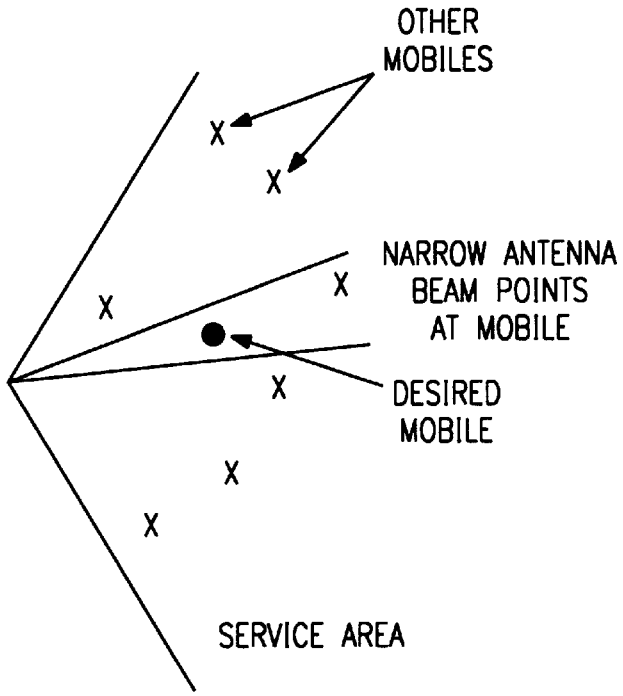
FIG. 3 is a diagrammatic illustration of the operation of the system of FIGS. 1A and 1B.

By employing narrow multiple beams instead of the wide single beams used in present systems, substantial performance improvement is achieved. First, since narrow beams are more highly directional, focus on the signal from a desired mobile in a wireless communications system can be made to the exclusion of signals from other mobiles operating in the same sector. This focusing is preferably done on the basis of the mobile user's assigned identification code. This feature reduces the interference from undesired mobiles. An example is shown in FIG. 3 where eight mobile units are operating in the sector with the CDMA attempting to receive a single mobile based on the users identification code). Six of the other mobiles are excluded as being outside the beam coverage of the narrow beam directed at the desired mobile; noise from direct signals is thereby reduced from 7 noise units to 1.

Similarly, beams utilizing different polarization to focus on the signal from a desired mobile can be utilized to exclude signals from other mobiles operating in the same sector. For example, users of hand held mobiles very rarely hold the mobile unit antenna vertically, and instead typically cock the unit at approximately 45 degrees, whereas mobiles mounted in vehicles typically utilize a vertically mounted antenna. As a result, beams polarized differently, i.e., vertical, slant left and slant right, may be used to focus on a desired mobile unit. As described above, this focusing is preferably done on the basis of the mobile user's assigned identification code. This feature reduces the interference from undesired mobiles polarized differently than the desired mobile, as their signal component in the cross-polarization direction is removed by selecting only a cross polarized beam.

In addition to reducing interference by excluding undesired mobiles, narrower beams generally provide higher gain. Higher gain allows the mobiles to transmit with less power or operate over longer paths (separations from the base station) with the same power. Finally, the multibeam approach, whether providing angular or polarization diversity, is advantageously compact as signal diversity does not depend on separation of the beam sources.

As discussed above, substantial spacing is not required to maintain signal separation with the present invention. Beams (from either a multiple-beam antenna or a plurality of discrete antennas) may provide signal diversity through the use of, for example, antennas with angular diversity, spatial diversity, polarization diversity, or any combination thereof. To provide angular diversity, beams are adapted to provide different angular coverage (i,e. each beam has a different azimuthal view). Since each beam is viewing a different phase front, the signals received by such beams are uncorrelated and can be accordingly processed by the Rake receiver.

An antenna adapted to provide angular diversity is shown in FIG. 1A as antenna 101. Here, each beam 1 through N, although having a co-located source, is disposed to see a different area of the sector and therefore receive a different wave front.

Polarization diversity is accomplished by adapting beams to provide differing polarization. Since beams of each polarization are responsive only to radiated signals having a matching polarization component, the signals received by the beams may be uncorrelated and may be processed accordingly by the Rake receiver.

It should be noted that polarized antenna beams may improve performance other than by their utilization to provide uncorrelated signals. As discussed above, users of hand held mobiles very rarely hold the mobile unit antenna vertically, such that the polarization of the mobile unit antenna matches that of the base station. As a result, the component in the cross-polarization direction is lost at the base station. Antenna 101 may therefore be constructed from a plurality of polarized multibeam antennas whose patterns overlap such that the cross-over from one pattern is at the peak of another. The polarization of a second antenna is preferably orthogonal (or at least offset) from the polarization of a first antenna. For example, the first and second antennas may be right hand and left hand circularly polarized or horizontally and vertically polarized, respectively. With such an arrangement, the signal component in the cross-polarization direction may now be received by a cross-polarized second antenna, thus improving signal reception.

Figure 8:
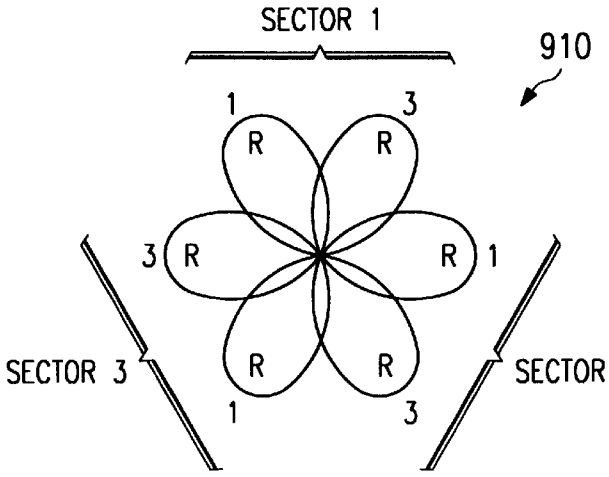
FIG. 8 illustrates overlapping beams providing polarization diversity.
Figure 8:
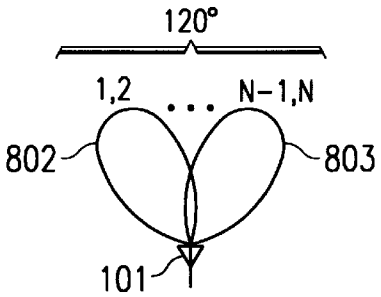

Antenna 101 adapted to provide polarization diversity is shown in FIG. 8 having beams differently polarized overlapping. Here, alternating beams are each polarized differently. For example, beams 1 and 2, shown overlapping, may provide radiation pattern 802 with right hand and left hand polarization respectively. Similarly, beams N−1 and N, also shown overlapping, may provide radiation pattern 803 with right hand and left hand polarization respectively.

It shall be appreciated that, although the embodiment of FIG. 8 has been discussed with respect to polarization diversity alone, such an embodiment inherently provides angular diversity as well. Angular diversity is provided by the multiple narrow beams disposed for different azimuthal coverage within the sector.

It shall be appreciated that use of such overlapping beams requires either less narrow beam widths or additional beams to provide the same azimuthal coverage as the angularly diverse system described above. For example, where four 30 degree beams provide 120 degree coverage with the antenna of FIG. 1A, four 60 degree beams provide 120 degree coverage with the antenna of FIG. 8. Of course, consistent with the principles of the present invention, more than four beams per sector may be utilized by cascading additional delay elements in the signal paths. Likewise, partially overlapping beams may be utilized by the present invention to provide polarization diversity, if desired.

To provide spatial diversity, beam sources are physically spaced an appreciable distance apart. Here, since each beam source presents a different signal path length between the communications devices, the signals received by the beams are uncorrelated and are suitable for processing by the Rake receiver.

Figure 9A:
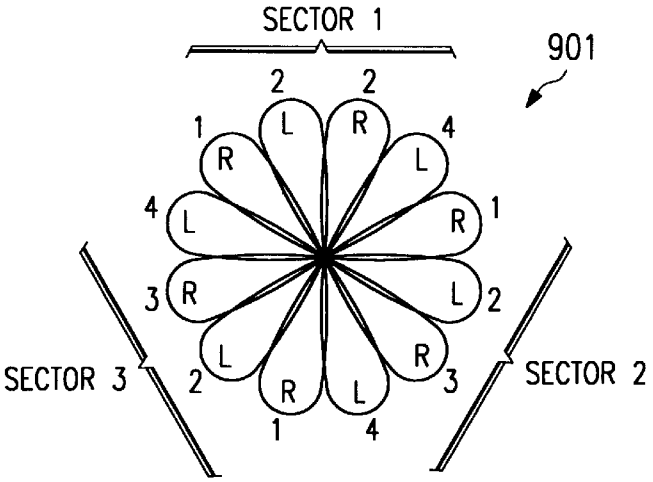
FIGS. 9A–9C illustrate alternative embodiments of the multiple beams of the present invention.
Figure 9B:
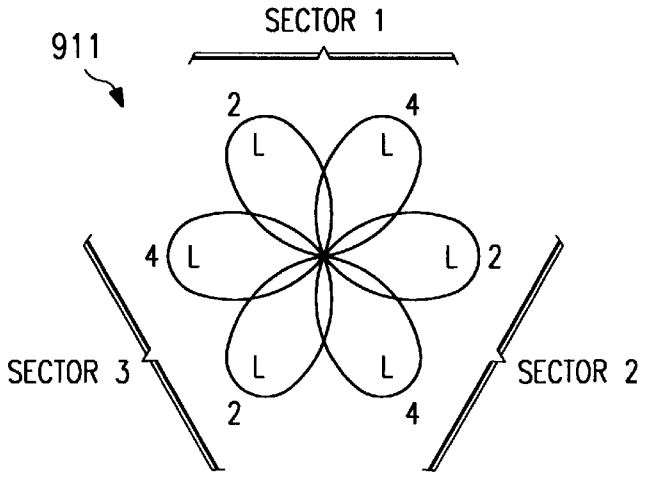
Figure 9C:
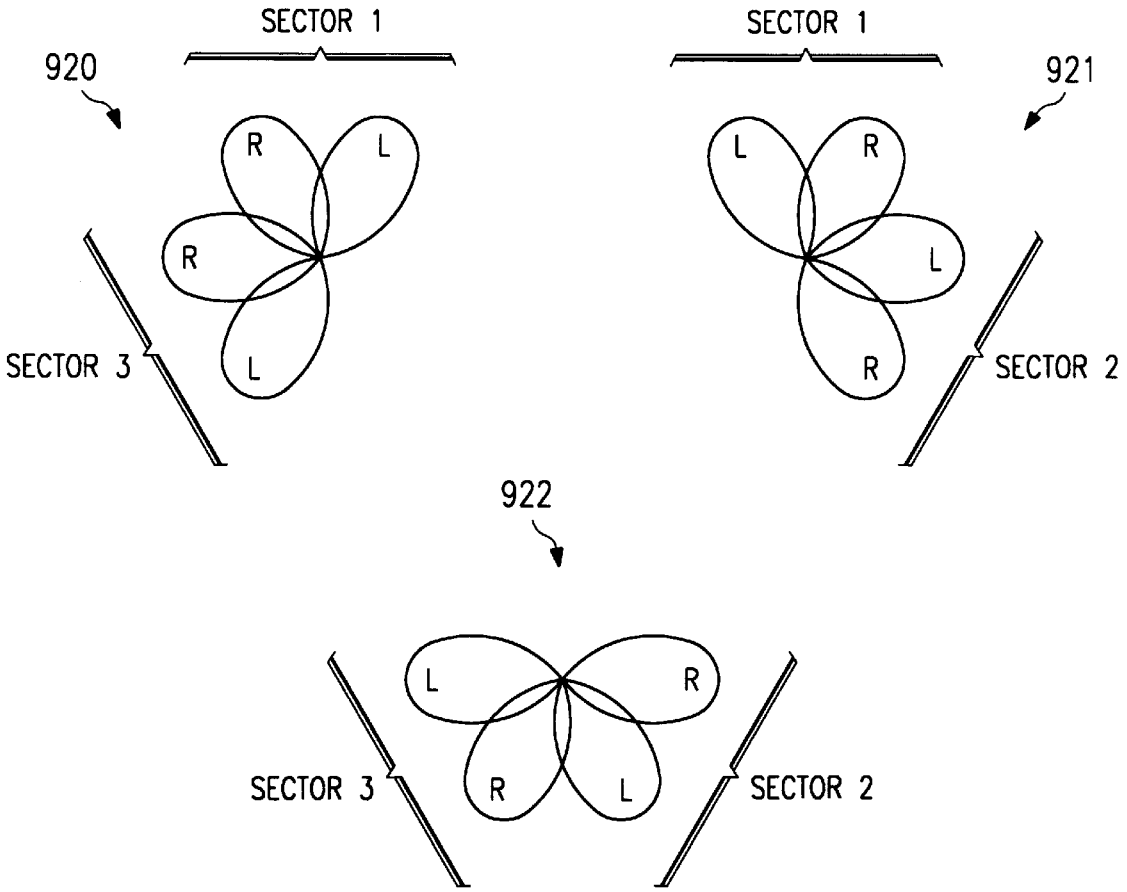

Directing attention to FIGS. 9A through 9C, various combinations of the aforementioned signal diversity methods are shown as being implemented in a three sectored cell. FIG. 9A shows an alternative embodiment providing angular diversity in combination with polarization diversity as antenna system 901. It shall be understood that the beams of each sector may be provided as discussed above with respect to antenna 101. Here non-overlapping antenna beams 1 through 4 of each sector are adapted to provide both angular diversity and polarization diversity (where L=left polarization and R=right polarization).

Directing attention to FIGS. 9B and 9C, alternative embodiments of the present invention utilizing angular diversity in combination with both polarization diversity and spatial diversity may be seen. FIG. 9B utilizes spatially diverse antenna systems 910 and 911 to provide spatial diversity. The beams of antenna system 910 and 911 providing overlapping azimuthal coverage provide different polarization. Here each beam of antenna system 910 provides right hand polarization while each beam of antenna system 911 provides left hand polarization. Of course, alternating beam polarization may be utilized at each antenna system as shown in FIG. 9A described above and FIG. 9C described below, if desired.

FIG. 90 utilizes three spatially diverse antenna systems, shown as antenna systems 920 through 922, to provide spatial diversity. Such a system provides the benefit of substantially reducing interference introduced by the various beams of the antenna systems transmitting directly through its spatially removed counterpart.

Although antenna systems utilizing angular diversity have been described above, it shall be appreciated that advantages of the present invention may also be realized through antenna systems adapted so as not to provide angular diversity. For example, a multiple beam sector may be adapted to provide four 120 degree overlapping beams according to the present invention. Signal diversity for such beams may be provided through the use of, for example, different polarization for each beam (i.e., left hand polarization for a first beam, vertical polarization for a second beam, right hand polarization for a third beam, and horizontal polarization for a fourth beam).

Figure 4:
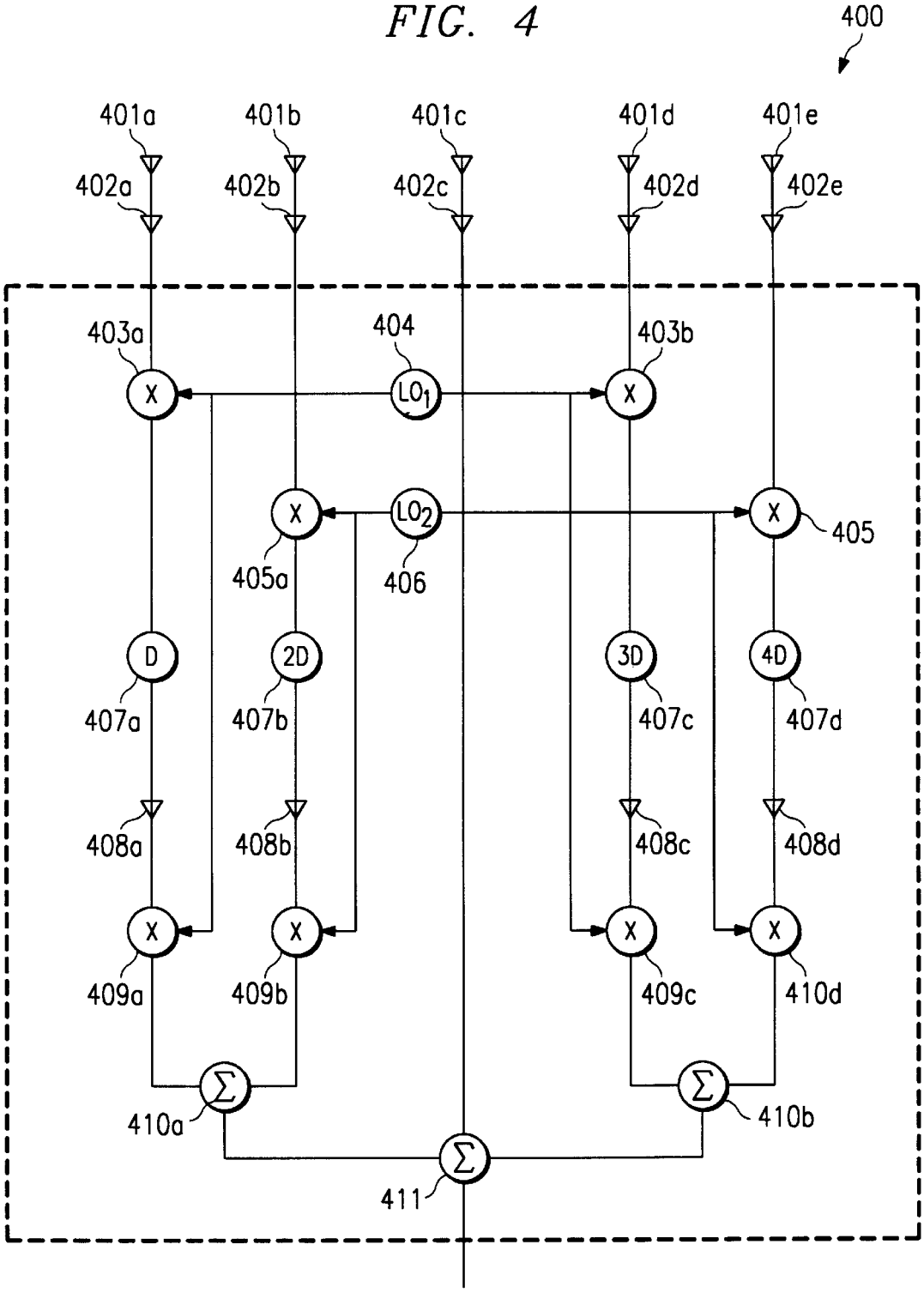
FIG. 4 is a functional block diagram of an alternate antenna system for use in a receiving system embodying the present invention.

The principles of the present invention are not limited to the use of multibeam antennas and may be equally applied to systems using multiple discrete antennas. A discrete antenna system 400 according to the principles of the present invention is depicted in FIG. 4. In a conventional CDMA receiving system, two antenna systems 400 are employed per face, one to feed the main port and the other to feed the diversity port.

Antenna system 400 includes N-number of antennas 401. Five antennas 401*a*–401*e* are depicted in FIG. 1, although in alternate embodiments the number N will vary. The coverage of antennas 401 will also vary from application to application. For example, for a three sector receiving system, the N-number of antennas will provide 120 degrees of coverage for the corresponding face and in an omni-directional system provide 360 degrees of coverage.

The signals output from each of antennas 401 are passed through a low noise amplifier 402 to improve the system noise figure. Next, the signals from each antenna 401, with the exception of the signals from antenna 401*c*, are mixed down by mixers 403. In the illustrated embodiment, the signals from antennas 401*a* and 401*d* are mixed with a signal from local oscillator ($LO_1$) 404 with mixers 403*a* and 403*b* and the signals from antennas 401*b* and 401*e* are mixed from a second local oscillator ($LO_2$) 406 with mixers 405*a* and 405*b*. Local oscillators 404 and 406 preferably output a local oscillator signal at the same frequency. In cellular telephone and PCS systems where the incoming RF signals are at a frequency of 800 MHz or 1.8 GHz, the local oscillator signal is selected to provide an IF signal of 70 or 140 MHz. Two local oscillators 404 and 406 are provided in the illustrated embodiment such that if one fails, some system receiving capability is maintained. In alternate embodiments, only a single local oscillator may be used.

After mixing, the IF signals are passed through delays 407*a*–407*d*. The delays are selected according to the principles of the present invention discussed above. The output of each of the delays 407 is then passed through a corresponding amplifier 408. The gain of amplifiers 408 is set proportional to the signal energy on that path. Next, the IF signals are up mixed using local oscillators 404 and 406. By mixing back to the original RF frequency, antenna system 400 appears transparent to the CDMA receiver with regards to frequency.

The delayed outputs from antennas 401*a* and 401*b* are combined with combiner 410*a* and the delayed outputs of antennas 401*d* and 401*e* are combined with combiner 410*b*. The output of combiners 410*a* and 410*b* and the direct output of antenna 410*c* are then combined with combiner 411, whose output is fed to the respective sector or diversity port of the associated receiver.

It should be noted that the center antenna 401*c* in this embodiment may be used in different ways depending on the application. For example, it could be switched to the receiver as a path with a delay of zero and have a field of view similar to the other antennas 401. In the alternative, antenna 401*c* may encompass the entire field of view of antennas 401 and output signals at a lower power level. For example, if antennas 401*a*, 401*b*, 401*d* and 401*e* together cover a 120° sector, antenna 401*c* similarly covers 120 degrees. In this case, antenna 401*c* normally would not be selected but used only if the delayed paths failed; the single antenna 401*c* would still provide some reduced performance.

Antenna system 400 not only allows for discrete narrow beam antennas to be used in a receiving system, but also allow for the use of multiple antennas in CDMA receiving systems in which the receiver has a limited number of input ports. For example, some CDMA receivers are designed to operate with omni-directional antennas and thus only have one main port and one diversity port. According to the present invention, multiple narrow beam antennas can be coupled to those ports. The narrow beam approach of system 400 advantageously provides higher gain, reduced multipath and reduced outside interference, as well as increasing the number of antennas which may be used.

Figure 5:
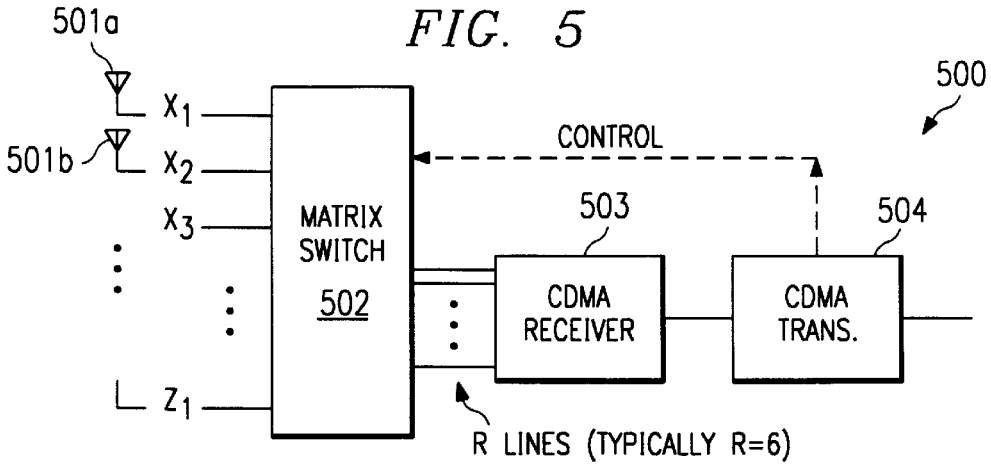
FIG. 5 is a functional block diagram of an alternate receiving system according to the present invention.

An alternative embodiment of the principles of the present invention is depicted in FIG. 5. Receiving system 500 uses multiple discrete antennas 501 to direct antenna beams to the mobile units. These multiple antennas preferably produce narrow beams, and may be utilized to provide angular, spatial, or polarization diversity as has been discussed above. In the embodiment of FIG. 5, a matrix switch 502 switches a selected number of antennas to CDMA receiver 503. The CDMA transmitter 504 is also shown for reference. Assume for discussion purposes that the three face system of FIG. 2 is being implemented.

Assuming for discussion that R=6, R being the number of lines coupling matrix switch 502 and receiver 503, if j=k=m=4, j, k, and m being the number of antennas in each sector, then the outputs from two selected antennas per sector are coupled to receiver 503. Preferably, with current CDMA receiver technology, only signals from antennas associated with a single sector are provided to a main and diversity input port pair of receiver 503. For example, two antenna beam signals from a first sector may be provided to a first sector main and diversity input port pair of receiver 503 while two antenna beam signals from a second sector are provided to a second sector main and diversity input port pair of receiver 503. Of course, signals associated with different sectors may be provided to the same input port pair of a receiver where it is deemed advantageous.

Receiver 503 automatically selects three antennas providing the strongest output for input into a sector input port of each input port pair of receiver 503. Accordingly, a signal of another antenna of the sector containing the particular antenna having the strongest signal, such as an antenna adjacent to the antenna providing the strongest signal, is provided to the associated input port of the input port pair. Of course, many other combinations are possible.

Finally, assuming j, k, or m is greater than R, then the apparatus and methods discussed above with regards to FIGS. 1–3 are preferably employed.

Figure 6:
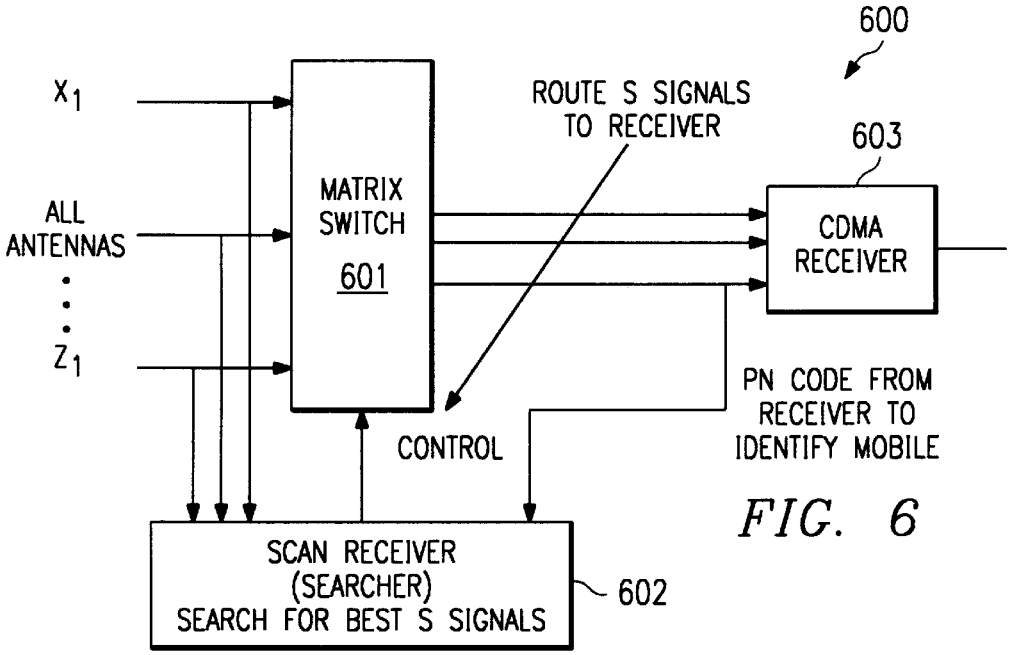
FIG. 6 is a functional block diagram of another alternate receiving system according to the present invention.

FIG. 6 depicts a further system for communication CDMA signals. As with the apparatus, systems and methods discussed above, the system of FIG. 6 advantageously allows for the use of narrow beam antennas and/or for the use of more antennas than inputs are available at the receiver or transmitter. In this system, the antennas $X_1$–$Z_m$ are coupled to a matrix switch 601. Matrix switch 601, under the control of a scan receiver 602, selectively couples S number of signals to a CDMA receiver 603. Scan receiver 602 may or may not be integral with CDMA receiver 603.

Specifically, during operation, scan receiver 602 searches across all the antennas for the S number of strongest signals bearing the identification code of the desired mobile. Once these signals have been identified, matrix switch 601, under control of scan receiver 602, couples those antennas outputting the S strongest signals with CDMA receiver 603.

Although the present invention has been discussed with reference to reception of a transmitted signal, it shall be appreciated that the advantages of the present invention are equally advantageous for use in transmission of a signal. Systems for providing a signal to a plurality of antenna beams in the forward link are disclosed in the above referenced copending patent application Ser. No. 08/520,316, now Pat. No. 5,648,968, entitled "Narrow Beam Antenna Systems with Angular Diversity," and copending patent application Ser. No. 08/520,000, now Pat. No. 5,859,854, entitled "System and Method for Frequency Multiplexing Antenna Signals," each of which has been incorporated herein by reference.

Although the present invention and its advantages have been described in detail, it should be understood that various changes, substitutions and alterations can be made herein without departing from the spirit and scope of the invention as defined by the appended claims.

What is claimed is:

1. A communication system comprising:

an antenna array providing a plurality of antenna beams, said antenna array adapted for providing signal diversity between beam signals, wherein said signal diversity is provided at least in part by ones of said antenna beams having diverse polarizations, a first group thereof having a first polarization and a second group thereof having a second polarization;

a first processing branch for processing first beam signals, said first beam signals associated with a first selected set of one or more of said antenna beams, said first processing branch comprising:

a first plurality of signal paths wherein at least one signal path is a delay path, each of said signal paths communicating at least one of said first beam signals with a corresponding antenna beam in said first selected set thereof, wherein said delay path introduces a preselected amount of delay to signals communicated thereby; and a combiner for combining said first beam signals, said first plurality of signal paths being disposed between said combiner and said antenna array;

a second processing branch for processing second beam signals, said second beam signals appearing within a second selected set of one or more of said antenna beams, said second processing branch comprising:

at least one signal path communicating at least one of said second beam signals with a corresponding antenna beam in said second selected set thereof, and a radio apparatus having a first port coupled to an interface of said first processing branch and a second port coupled to an interface of said second processing branch.

2. The communication system of claim 1, wherein said radio apparatus comprises a Rake receiver.

3. The communication system of claim 1, wherein said radio apparatus comprises a signaling radio.

4. The communication system of claim 1, wherein beams of said plurality of beams are narrow beams providing azimuthal coverage of less than 120 degrees.

5. The communication system of claim 1, wherein beams of said first group of polarization diverse antenna beams are substantially overlapped by beams of said second group of polarization diverse antenna beams.

6. The communication system of claim 1, wherein said signal diversity is provided at least in part by ones of said antenna beams disposed to provide angular diversity.

7. The communication system of claim 6, wherein said signal diversity is also provided at least in part by ones of said antenna beams having diverse polarizations.

8. The communication system of claim 1, wherein said signal diversity is provided at least in part by ones of said antenna beams disposed to provide spatial diversity.

9. The communication system of claim 8, wherein said signal diversity is also provided at least in part by ones of said antenna beams disposed to provide angular diversity.

10. The communication system of claim 1, wherein said signal diversity is also provided at least in part by ones of said antenna beams disposed to provide spatial diversity, and said signal diversity is further provided at least in part by ones of said antenna beams disposed to provide angular diversity.

11. The communication system of claim 1, wherein each signal path of said first plurality of signal paths introduces substantially the same amount of delay as said preselected amount of delay.

12. The communication system of claim 11, wherein said preselected amount of delay comprises the length of said signal paths.

13. The communication system of claim 1, in which the second processing branch further comprises:

a second plurality of signal paths wherein at least one signal path is a delay path, each of said signal paths communicating at least one of said second beam signals with a corresponding antenna beam in said second selected set thereof, wherein said delay path introduces a preselected amount of delay to signals communicated thereby; and a combiner for combining said second beam signals, said second plurality of signal paths being disposed between said combiner and said antenna array.

14. The communication system of claim 13, wherein:

each of said second selected set of antenna beams is arranged in a hierarchy; and said preselected amount of delay introduced by each of said at least one delay path of said second processing branch is a function of each of said antenna beam's hierarchal position and a predetermined constant delay period.

15. The communication system of claim 14, wherein said preselected constant delay is selected to exceed a signal resolution of said radio apparatus.

16. The communication system of claim 13, wherein: said preselected amount of delay introduced by each of said at least one delay path of said second processing branch is different.

17. The system of claim 13, wherein said second plurality of signal paths comprises at least one undelayed signal path.

18. The system of claim 1, wherein said first plurality of signal paths comprises at least one undelayed signal path.

19. The communication system of claim 1, wherein:

said preselected amount of delay introduced by each of said at least one delay path of said first processing branch is different.

20. The communication system of claim 1, wherein:

each of said first selected set of antenna beams is arranged in a hierarchy; and said preselected amount of delay introduced by each of said at least one delay path of said first processing branch is a function of each of said antenna beam's hierarchal position and a predetermined constant delay period.

21. The communication system of claim 20, wherein said preselected constant delay is selected to be long enough to exceed a signal resolution of said radio apparatus.

22. The communication system of claim 1, wherein said antenna array comprises a multibeam antenna.

23. The communication system of claim 1, wherein said antenna array comprises a plurality of discrete antennas.

24. The communication system of claim 1, wherein said combiner is a summing device.

25. The communication system of claim 24, wherein the summing device sums said plurality of signals giving weight to the signal strength on each signal path.

26. The communication system of claim 25, wherein the weight given is proportional to the signal strength.

27. The communication of claim 1, wherein said combiner means includes a selector switch to exclude certain signal paths according to the signal strength on those paths.

28. A method of providing wireless communication signals between communication devices, wherein diverse renditions of said signals are associated with a sector and diversity port of a CDMA radio, said method including the steps of:

arranging a plurality of antenna beams to illuminate an area in which signals are expected to be communicated, said antenna beams adapted to provide said diversity between signals;

distributing the signals associated with ones of the beams so that a preselected group of the signals are distributed by first circuitry and other ones of the signals are distributed by second circuitry;

processing the signals, wherein said processing step includes the substeps of:

delaying at least one of the signals distributed by said first circuitry by a first preselected amount; and combining ones of the signals together to form two signal sets, one set for presentation to the sector input and one set for presentation to the diversity input of said CDMA radio.

29. The method of claim 28, wherein said diversity between signals is provided at least in part by ones of said antenna beams having different polarizations, a first group thereof having a first polarization and a second group thereof having a second polarization.

30. The method of claim 29, wherein beams of said first group of polarization diverse antenna beams are substantially overlapped by beams of said second group of polarization diverse antenna beams.

31. The method of claim 29, wherein said plurality of beams are narrow beams and beams of said first group of polarization diverse antenna beams are interlaced with beams of said second group of polarization diverse antenna beams.

32. The method of claim 28, wherein said diversity between signals is provided at least in part by ones of said antenna beams disposed to provide different angular views.

33. The method of claim 32, wherein said diversity between signals is also provided at least in part by ones of said antenna beams having different polarizations, a first group thereof having a first polarization and a second group thereof having a second polarization.

34. The method of claim 28, wherein said diversity between signals is provided at least in part by ones of said antenna beams disposed to provide significant spatial separation.

35. The method of claim 32, wherein said diversity between signals is also provided at least in part by ones of said antenna beams having different polarizations, a first group thereof having a first polarization and a second group thereof having a second polarization.

36. The method of claim 32, wherein said diversity between signals is also provided at least in part by ones of said antenna beams disposed to provide different angular views.

37. The method of claim 28, wherein said diversity between signals is provided at least in part by ones of said antenna beams disposed to provide significant spatial separation, said diversity between signals is also provided at least in part by ones of said antenna beams having different polarizations, a first group thereof having a first polarization and a second group thereof having a second polarization, and said diversity between signals is also provided at least in part by ones of said antenna beams disposed to provide different angular views.

38. The method of claim 28, wherein said delaying step includes the step of:

delaying each of the signals distributed by said first circuitry by a delay substantially same as said first preselected amount.

39. The method of claim 38, wherein said preselected amount of delay is introduced by the length of said signal paths.

40. The method of claim 28, wherein said processing step further comprises the substeps of:

not delaying at least one of the signals distributed by said first circuitry; and not delaying at least one of the signals distributed by said second circuitry.

41. The method of claim 28, wherein said processing step further comprises the substep of delaying at least one of the signals distributed by said second circuitry by a second preselected amount.

42. The method of claim 41 wherein said first and second preselected amounts of delay are the same.

43. The method of claim 41, wherein said preselected amounts of delay are selected to exceed a signal resolution of said CDMA radio.

44. The method of claim 42, wherein each of said first and second preselected amounts of delay are characterized as DN/2, where D is a unit of delay and N is a hierarchal number of the antenna beam associated with a particular delay.

45. The method of claim 42, wherein said preselected amounts of delay introduced by each of said at least one delay path of said second processing branch is different.

46. The method of claim 42, wherein said preselected amounts of delay introduced by each of said at least one delay path of said first processing branch is different.

47. The method set forth in claim 28, further including the step of:

selecting, from among all of the signals, a subset thereof to be distributed in said distributing step wherein said selected signals meet a given criterion.

48. The method of claim 28, wherein adjacent antenna beams of said preselected group of antenna beams have alternate polarization.

49. A system comprising:

a plurality of antenna beams having beam signals associated therewith, said beam signals providing signal diversity between ones of beam signals of said plurality of antenna beams;

a first processing branch for processing first beam signals, said first beam signals associated with a first selected set of one or more of said antenna beams, said first processing branch comprising:

a first plurality of signal paths, each of said signal paths communicating at least one of said first beam signals with a corresponding antenna beam in said first selected set thereof; and a combiner for combining said first beam signals;

a second processing branch for processing second beam signals, said second beam signals associated with a second selected set of one or more of said antenna beams, wherein said first and second sets of antenna beams are mutually exclusive, said second processing branch comprising:

a second plurality of signal paths, each of said signal paths communicating at least one of said second beam signals with a corresponding antenna beam in said second selected set thereof; and a combiner for combining said second beam signals; and a radio apparatus having a first port coupled to an output of said first processing branch and a second port coupled to an output of said second processing branch.

50. The system of claim 49, wherein beams of said plurality of beams are narrow beams providing azimuthal coverage of less than 120 degrees.

51. The system of claim 49, wherein said signal diversity is provided at least in part by ones of said antenna beams having diverse polarizations, a first group thereof having a first polarization and a second group thereof having a second polarization.

52. The system of claim 49, wherein said signal diversity is provided at least in part by ones of said antenna beams disposed to provide angular diversity.

53. The system of claim 52, wherein said signal diversity is also provided at least in part by ones of said antenna beams having diverse polarizations.

54. The system of claim 49, wherein said signal diversity is provided at least in part by ones of said antenna beams disposed to provide spatial diversity.

55. The system of claim 54, wherein said signal diversity is also provided at least in part by ones of said antenna beams having diverse polarizations.

56. The system of claim 54, wherein said signal diversity is also provided at least in part by ones of said antenna beams disposed to provide angular diversity.

57. The system of claim 49, wherein said signal diversity is provided at least in part by ones of said antenna beams disposed to provide spatial diversity, said signal diversity also provided at least in part by ones of said antenna beams having diverse polarizations, and said signal diversity further provided at least in part by ones of said antenna beams disposed to provide angular diversity.

58. A wireless communications system, comprising:

a plurality of antennas, said antennas disposed to communicate signals on beams having a narrow beam width, said beams adapted to provide substantially uncorrelated signals;

a CDMA receiver, said receiver having a number of inputs less than or equal to the number of said plurality of antennas;

at least one first undelayed path and at least one first delay path, said paths coupling corresponding first ones of said beams with a first input port of said receiver, each of said first delay paths also introducing a predetermined amount of delay to a signal received from a corresponding one of said first ones of said beams; and at least one second undelayed path and at least one second delay path, said paths coupling corresponding second ones of said beams with a second input port of said receiver, each of said second delay paths also introducing a predetermined amount of delay to a signal received from a corresponding one of said second ones of said beams.

59. The system of claim 58, wherein said substantially uncorrelated signals are provided at least in part by ones of said antenna beams having polarization diversity, a first group thereof having a first polarization and a second group thereof having a second polarization.

60. The system of claim 59, wherein said first group is associated with said first signal paths and said second group is associated with said second signal paths.

61. The system of claim 60, wherein beams of said first group are substantially overlapped by beams of said second group, and a cross-over of a pair of said first group of beams coincides with a peak of a beam of said second group.

62. The system of claim 59, wherein ones said first group are interlaced with beams of said second group, said interlace beams being associated with said first signal paths.

63. The system of claim 58, wherein said substantially uncorrelated signals are provided at least in part by ones of said antenna beams having angular diversity.

64. The system of claim 63, wherein said substantially uncorrelated signals are also provided at least in part by ones of said antenna beams having polarization diversity.

65. The system of claim 58, wherein said substantially uncorrelated signals are provided at least in part by ones of said antenna beams having spatial diversity.

66. The system of claim 65, wherein said substantially uncorrelated signals are also provided at least in part by ones of said antenna beams having polarization diversity.

67. The system of claim 65, wherein said substantially uncorrelated signals are also provided at least in part by ones of said antenna beams having angular diversity.

68. The system of claim 58, wherein said substantially uncorrelated signals are provided at least in part by ones of said antenna beams having spatial diversity, said substantially uncorrelated signals also provided at least in part by ones of said antenna beams having polarization diversity, and said substantially uncorrelated signals also provided at least in part by ones of said antenna beams having angular diversity.

69. The receiving system of claim 58, wherein said first input port of said receiver is a sector input port and said second input of said receiver is a diversity input port.

70. The system of claim 58, wherein said predetermined delay introduced by each of said first and second delay paths is a function of placement of an associated antenna beam in a hierarchy of antenna beams.

71. A system for use in communicating signals between a plurality of communication devices, said system comprising:

a communication device having at least a first and second signal port associated therewith;

a plurality of signal beams, ones of said plurality of signal beams being adapted to utilize signals having alternate ones of a set of signal attributes to thereby provide diverse signal attributes, wherein said diverse signal attributes are provided at least in part by ones of said signal beams having different polarization wherein ones of said plurality of signal beams are identified as a first set of signal beams and ones of said plurality of signal beams are identified as a second set of signal beams;

a first signal feed network associated with said first set of signal beams communicating signals of said first set of signal beams between said first set of signal beams and said first port of said communication device, said first signal feed network introducing at least one delay into a signal of said first set of signal beams; and a second signal feed network associated with said second set of signal beams communicating signals of said second set of signal beams between said second set of signal beams and said second port of said communication device.

72. The system of claim 71, wherein said diverse signal attributes are provided at least in part by ones of said signal beams having different angular disposition.

73. The system of claim 71, wherein said diverse signal attributes are provided at least in part by ones of said signal beams having different spatial disposition.

74. The system of claim 71, wherein adjacent signal beams of said first set of signal beams have alternate polarization of said different polarization.

* * * * *